US005131339A

United States Patent [19]

Goodridge

[11] Patent Number: 5,131,339

[45] Date of Patent: Jul. 21, 1992

[54] METHOD AND APPARATUS FOR AUTOMATICALLY GUIDING A PIECE OF FABRIC HAVING AN UNDULATING EDGE THROUGH A SEWING POSITION

[75] Inventor: Richard J. Goodridge, Northampton, England

[73] Assignee: GEC Electrical Projects Limited, England

[21] Appl. No.: 416,141

[22] Filed: Oct. 2, 1989

[30] Foreign Application Priority Data

Oct. 4, 1988 [GB] United Kingdom ..... 8823215

[51] Int. Cl.[5] ..... D05B 21/00

[52] U.S. Cl. ..... 112/262.3; 112/308; 112/121.12; 271/227

[58] Field of Search ..... 112/306, 308, 309, 262.3, 112/266.1, 121.12, 121.11; 271/10, 85, 241, 227, 228, 261, 268

[56] References Cited

U.S. PATENT DOCUMENTS

| | | | |
|---|---|---|---|
| 3,385,244 | 5/1968 | Ramsey et al. | 112/121.12 |
| 3,459,145 | 8/1969 | Ransey, et al. | 112/121.11 |
| 3,609,373 | 9/1971 | Desai et al. | 112/121.12 |
| 4,353,539 | 10/1982 | Doyen et al. | 112/121.12 X |
| 4,435,837 | 3/1984 | Abernathy | 271/227 X |
| 4,498,404 | 2/1985 | Sadeh | 112/121.12 |
| 4,526,116 | 7/1985 | Mannel | 112/121.12 X |
| 4,602,578 | 7/1986 | Yokoe et al. | 112/121.15 |
| 4,660,484 | 4/1987 | Yasui | 112/121.12 X |
| 4,971,304 | 11/1990 | Lofthus | 271/227 |

FOREIGN PATENT DOCUMENTS

| | | |
|---|---|---|
| 0075801 | 4/1983 | European Pat. Off. . |
| 3606210 | 8/1986 | Fed. Rep. of Germany . |
| 2106272 | 4/1983 | United Kingdom . |

*Primary Examiner*—Peter Nerbun

*Attorney, Agent, or Firm*—Kirschstein, Ottinger, Israel & Schiffmiller

[57] ABSTRACT

A mass production system for the manufacture of garments comprises a number of gantry robots which move shaped pieces of fabric over a work table between sewing and manipulating positions. In the sewing of scalloped lace to a garment, the sewing direction must always be parallel to the tangent to the undulating edge of the lace. The piece of lace is viewed by a camera, and the position of a notional datum line, such as a line passing through the minima of the undulations, is specified. Displacements of points along the edge of the lace are then determined relative to the datum line. Displacement and orientation values for guiding that particular piece of lace through a sewing position to produce a row of stitches at a constant distance inside the edge are calculated, and the piece of lace is subsequently guided through the sewing position in accordance with those values.

7 Claims, 1 Drawing Sheet

Fig.1.
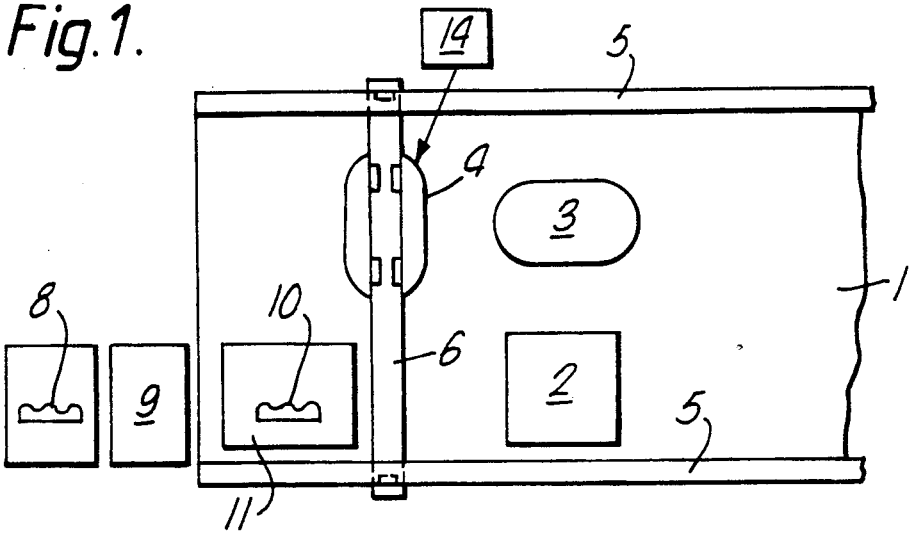
Fig.2.
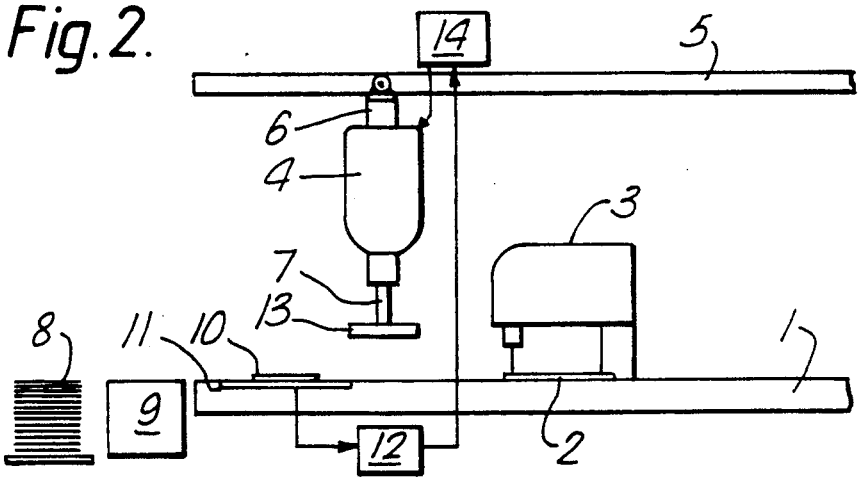
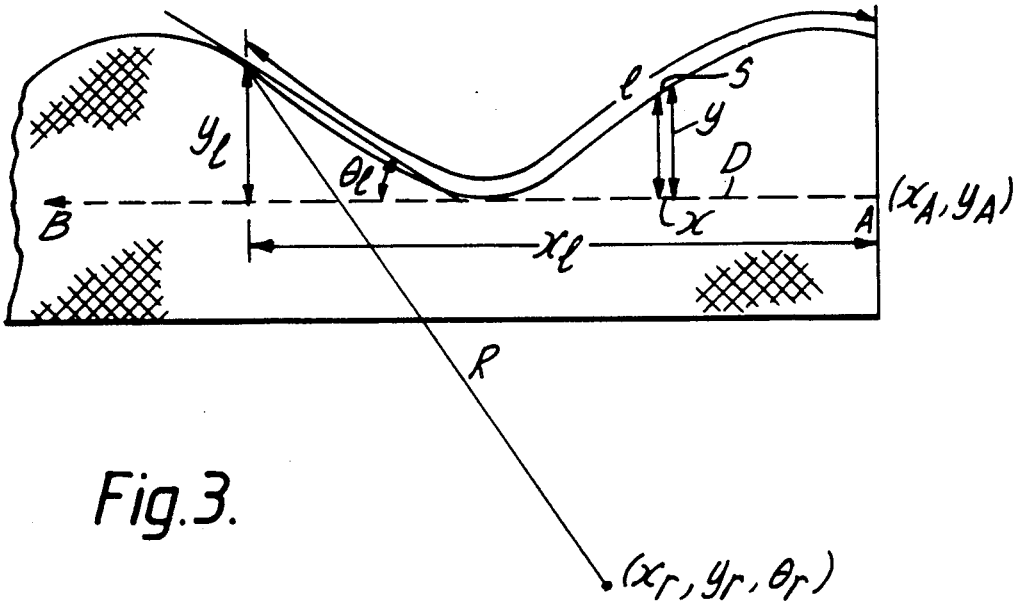
Fig.3.

METHOD AND APPARATUS FOR AUTOMATICALLY GUIDING A PIECE OF FABRIC HAVING AN UNDULATING EDGE THROUGH A SEWING POSITION

BACKGROUND OF THE INVENTION

1. Field of the Invention

This invention relates to the feeding of flexible sheets, and particularly to the feeding of pieces of fabric, such as lace, to a sewing position.

2. Description of Related Art

Garments, such as underclothes, have previously been manufactured by passing suitably-shaped pieces of fabric ("cut parts") to a machinist, who then overlays and/or folds them as required, and passes them manually through a sewing machine. The machinist forms seams, binds the edges of the cut parts and adds lace and elasticated waistbands, where necessary. The accuracy of the positioning of the seams and location of the lace, etc. relies on the machinist's skill.

Systems have been proposed for automating at least a part of the manufacturing process by using a robot to move a cut part to a work station, such as a sewing machine. The movement of the cut part is effected by a "gripper" which is mounted on the output shaft of the robot, and which makes contact with the upper surface of the cut part.

The movement of the cut part may be monitored by an electronic vision system, which controls the robot accordingly.

A machinist sewing scalloped lace on to a garment will guide the lace and the underlying fabric through the sewing machine, monitoring their positions by eye, so that the needle stays at a reasonably constant distance from the edge of the lace. The sewing direction must always be parallel to the tangent to the curved edge at each point.

If that procedure were to be attempted using an electronic vision system, a very complicated system would be required because the system must continuously determine what orientation of the lace and the fabric is needed, at every instant, to maintain the sewing line parallel to the edge. Furthermore, very little space is available around the sewing foot of the sewing machine for accommodating vision system components (i.e. light sources and photodiodes). Also, the operation of determining where the edge of the lace lies is very difficult for an electronic vision system to effect, bearing in mind that the lace will be lying on top of a cut part of a material which will very probably be the same color as the lace.

One possible method of sewing on such lace automatically would be to store data defining required movements of the lace and the fabric based on the assumption that scalloped lace has an absolutely regular, cyclically-varying outline. Unfortunately, that is far from the case. Lace is dimensionally very unstable, and a sewing method which relies on absolutely cyclical movements could very rapidly get completely out of phase with the actual shape of the lace. The stitching would then veer between being too far across the lace and being completely off its edge.

SUMMARY OF THE INVENTION

It is an object of the present invention to provide an improved method and apparatus for automatically guiding pieces of fabric having undulating edges through a sewing position so that the stitching closely follows the undulating edge.

According to one aspect of the invention there is provided a method of automatically guiding through a sewing position a piece of fabric which has an undulating edge, the method comprising electronically viewing said undulating edge; determining from the results of the viewing the position of a notional datum line relative to the undulations; determining respective displacements of points of the edge of the piece of fabric from the datum line at intervals along the undulations; determining therefrom displacement and orientation values required for subsequently guiding that piece of fabric through the sewing position to produce a row of stitches at a substantially constant distance inside said edge; and guiding the piece of fabric through the sewing position in accordance with said values.

According to another aspect of the invention there is provided apparatus for automatically guiding through a sewing position a piece of fabric which has an undulating edge, the apparatus comprising an electronic vision system for viewing the undulating edge; means responsive to the viewing of the edge to determine the position of a notional datum line for the edge, to determine respective displacements of points of the edge from the datum line at intervals along the undulations, and to determine therefrom displacement and orientation values required for subsequently guiding that piece of fabric through the sewing position to produce a row of stitches at a substantially constant distance inside said edge; and means to guide the piece of fabric through the sewing position in accordance with said values.

It is intended that "undulations" shall be taken to include displacements of the edge from a straight line whether cyclically or randomly occuring, and that "undulating" shall be interpreted accordingly.

BRIEF DESCRIPTION OF THE DRAWINGS

An embodiment of the invention will now be described, by way of example, with reference to the accompanying drawing, in which FIGS. 1 and 2 are schematic plan and side views, respectively, of part of a garment manufacturing system incorporating automatic guidance apparatus in accordance with the invention, and FIG. 3 is a schematic diagram illustrating a section of an undulating edge of a piece of lace.

DETAILED DESCRIPTION OF THE PREFERRED EMBODIMENT

Referring to FIG. 1, a garment manufacturing system includes a smooth flat work table 1, over which cut parts are to be moved between work stations, such as a manipulator 2 and a sewing machine 3, by a robot 4. The robot is of the gantry type, i.e. it is suspended over the table 1 from rails 5, 6 along which it moves in x and y directions. An output shaft 7 of the robot can move upwards and downwards (z motion) and can rotate about its vertical axis ($\theta$ motion).

When a piece of lace is to be sewn on to a garment, a ply separator and feeder 9 picks the top piece of lace off a pile 8 and feeds it on to the table. A piece of lace 10 is shown on the table after it has been placed there by the device 9. The ply separator and feeder 9 may, for example, be of the type disclosed in U.S. Pat. No. 4,353,539.

The undulations of the edge of the piece of lace on the table 1 are viewed by a video camera 11, which may be mounted above the table or may be built into the surface of the table. In FIGS. 1 and 2 the camera is shown in the latter position for clarity of the figures. The camera may comprise an array of pixels (e.g. 512×512) or may be a line scan camera, in which case relative movement between the camera and the lace part is necessary so that the whole of the undulating area is scanned. A line scan camera arrangement is capable of giving better resolution than a matrix camera, and takes up less space, but means for producing the relative movement must be provided. The output of the camera is fed to an image processing system 12.

A gripper 13 is mounted on the bottom of the robot shaft for moving the piece of lace to the manipulator 2 which lays the piece of lace on a base fabric. The gripper is a flat plate of suitable shape, which bears down on the lace so that the lace can be slid over the table with a speed, orientation and direction of movement which are continuously determined by a robot controller 14 which controls the movements of the robot 4. The manipulator 2 may, for example, be of the type disclosed in the above mentioned U.S. Pat. No. 4,353,539.

Referring to FIG. 3, the image processing system 12 derives a notional datum line D, which is a line passing through the mathematical minima of the lace edge profile. From the number of pixels operated in each matrix line or camera scan line, the system can determine the actual y value for the seam line for each x increment along the datum line. However, as the sewing machine is going to sew along the curve, the y values are recalculated for each increment s along the seam line curve, rather than using the values taken along the x axis. The seam line curve will be just inside the edge of the lace, by a constant predetermined distance. The increments can then be related to equal stitch counts.

The required orientation of the lace as it passes the sewing needle and foot (which have a fixed orientation) can then be calculated by the system from the successive x and y values at constant s intervals.

The system is programmed off-line to sew along the datum line D, but the robot controller 14 follows the x and y values and the required orientation $\theta$ for the particular piece of lace which has just been viewed. It causes the robot 4 to bring the gripper 13 into contact with that piece of lace, without appreciably changing the shape of the piece, and to feed the piece through the sewing machine in accordance with those calculated x, y and $\theta$ values.

It is preferable for the sewing machine speed to remain constant, which requires that the robot shall feed the lace through the sewing machine at a speed which varies to account for the undulating profile of the lace.

A typical procedure for operating the system would be as follows.

1. Adjust the data to correct for slight misalignment of the lace with the camera reference frame.
2. Filter the data to remove noise due to minor details of the lace.
3. Calculate the robot offsets needed to place the gripper correctly on the cut part.
4. Calculate the set of ordinates which measure the distance of the edge to be sewn from the line D passing through the minima of the profile.
5. Calculate a set of parameters which describe the seam profile as a set of x and y values at constant intervals of seam length s.

During the sewing of the lace, the following sequence of robot control is preferably carried out, the data being updated at, for example, 20 m sec intervals.

1. The length l of seam already sewn is calculated by integrating the pulses received from a sewing machine encoder multiplied by the effective stitch length.
2. Using the table of $\Delta x$ and y at constant intervals of seam length transmitted from the vision processing system, the values of $x_l$ and $y_l$ corresponding to seam length l are calculated by linear interpolation.
3. $x_l$ is the distance along the datum line D programmed by the offline system and, hence, this program can be used to obtain the values of robot axis positions $x_r$, $y_r$ and $\theta_r$ which would be needed to place the needle at $x_l$ along the line D. In fact, since D would be straight and parallel to the direction of sewing and the x axis of the robot, $y_r$ and $\theta_r$ will be constant for the nominal seam along the line D.
4. The angle of the seam at the current position relative to the line D is calculated from the values of $y_l$ adjacent to the current position and the value $\Delta x_l$ separating them.

$$\theta_l = \tan^{-1} \frac{yl_{i-1} - yl_i}{\Delta x_{l_i}}$$

5. In order to place the needle on the actual seam line it is necessary to offset the y axis position corresponding to D by $y_l$.

In addition it is necessary to rotate the work piece about the needle by $\theta_l$ to align the required seam line with the stitching direction of the machine.

Therefore the required robot axis positions are:

$$x_r = x_n + R \sin(\alpha + \theta_1)$$

$$y_r = y_n + R \cos(\alpha + \theta_1)$$

$$\text{where } \alpha = \tan^{-1} \frac{x_A + x_l - x_n}{y_A + y_l - y_n}$$

$$R = \sqrt{(x_A + x_l - x_n)^2 + (y_A + y_l - y_n)^2}$$

$x_A$, $y_A$ are the co-ordinates of the start of the seam defined by the offline system. $x_n$,$y_n$ are the co-ordinates of the needle.

It will be apparent that whereas the above description relates to the sewing of scalloped lace, the invention would be equally applicable to the sewing of any other piece of fabric having an undulating edge.

I claim:

1. A method of automatically guiding through a sewing position a piece of fabric which has an undulating edge and which is located on a base fabric to which it is to be sewn, the method comprising the steps of: electronically viewing said undulating edge; determining from the results of the viewing the position of a notional datum line related to a feature of the undulations; determining respective displacements of points of the edge of the piece of fabric from the datum line at intervals along the undulations; determining therefrom displacement and orientation values required for subsequently guiding that piece of fabric through the sewing position to produce a row of stitches at a substantially constant distance inside said edge; and guiding the piece of fabric and said base fabric through the sewing position with displacements and orientations in accordance with said values.

2. A method as claimed in claim 1, wherein the distance moved by the piece of fabric being guided past the sewing position is determined by counting electrical pulses related to the number of stitches effected since the beginning of the guiding.

3. A method as claimed in claim 1, wherein the guiding of the piece of fabric is effected by gripper means which makes contact with the piece of fabric; and wherein the gripper means is moved by robot means in accordance with said values.

4. Apparatus for automatically guiding through a sewing position a piece of fabric which has an undulating edge and which is located on a base fabric to which it is to be sewn, the apparatus comprising: an electronic vision system for viewing the undulating edge; means responsive to the viewing of the edge to determine the position of a notional datum line related to a feature of the undulating edge, to determine respective displacements of points of the edge from the datum line at intervals along the undulations, and to determine therefrom displacement and orientation values required for subsequently guiding that piece of fabric through the sewing position to produce a row of stitches at a substantially constant distance inside said edge; and means to guide the piece of fabric and said base fabric through the sewing position with displacements and orientations in accordance with said values.

5. Apparatus as claimed in claim 4, wherein the electronic vision system includes a camera comprising a matrix of sensing elements.

6. Apparatus as claimed in claim 4, wherein the electronic vision system includes a line scan camera; and wherein there is provided means to cause relative movement between the line scan camera and the piece of fabric, whereby the whole of the undulating edge is viewed.

7. Apparatus as claimed in claim 4, including gripper means for engaging the piece of fabric; and robot means for moving the gripper means in accordance with said values.

* * * * *